US007377298B2

(12) United States Patent
Pallmann

(10) Patent No.: US 7,377,298 B2
(45) Date of Patent: May 27, 2008

(54) CHIPPING APPARATUS HAVING A KNIFE RING

(75) Inventor: Hartmut Pallmann, Zweibruecken (DE)

(73) Assignee: Pallmann Maschinenfabrik GmbH & Co., KG, Zwelbruecken (DE)

( * ) Notice: Subject to any disclaimer, the term of this patent is extended or adjusted under 35 U.S.C. 154(b) by 419 days.

(21) Appl. No.: 11/043,974

(22) Filed: Jan. 28, 2005

(65) Prior Publication Data

US 2005/0166743 A1 Aug. 4, 2005

(30) Foreign Application Priority Data

Jan. 30, 2004 (DE) ..... 10 2004 004 877

(51) Int. Cl.
*B27C 1/00* (2006.01)

(52) U.S. Cl. ..... 144/172; 144/174; 241/91

(58) Field of Classification Search ..... 144/162.1, 144/172, 174, 176, 218; 241/91
See application file for complete search history.

(56) References Cited

U.S. PATENT DOCUMENTS 4,972,888 A * 11/1990 Dean ..... 144/172
6,554,032 B2 * 4/2003 Pallmann ..... 144/172
6,726,135 B2 * 4/2004 Pallmann ..... 241/32
6,757,952 B1 * 7/2004 Stager ..... 29/402.03
6,848,640 B2 * 2/2005 Pallmann ..... 241/292.1
6,926,051 B2 * 8/2005 Engman ..... 144/173

FOREIGN PATENT DOCUMENTS

DE 26 28 764 12/1977

* cited by examiner

*Primary Examiner*—Shelley M. Self
(74) *Attorney, Agent, or Firm*—Muncy, Geissier, Olds & Lowe, PLLC

(57) ABSTRACT

An apparatus for comminuting materials includes a rotating or stationary ring of knives that is arranged around a chipping chamber. The ring of knives is has a plurality of knife carriers, which are distributed around the knife ring axis in a circular shape, each knife carrier having a bearing surface. The bearing surface is a receptacle for a knife package that is comprised of a knife retaining plate and a slicing knife, and which is held in an operational position at a predetermined angle and a predetermined blade projection by fasteners. The knife carrier has a reference surface, which interacts with the knife package, and based on which the blade projection is determined. The slicing knife has at least one recess that originates in a rearward longitudinal edge, whereby the reference surface is arranged on the projection inside the recess, the projection extending vertically to the bearing surface.

19 Claims, 4 Drawing Sheets

CHIPPING APPARATUS HAVING A KNIFE RING

This nonprovisional application claims priority under 35 U.S.C. § 119(a) on German Patent Application No. DE 10 2004 004 877 filed in Germany on Jan. 30, 2004, which is herein incorporated by reference.

BACKGROUND OF THE INVENTION

1. Field of the Invention

The present invention relates to an apparatus for comminuting materials, the apparatus including a ring of knives that is arranged around a chipping chamber.

2. Description of the Background Art

Chipping devices of this class are known, for example, as knife ring chippers with an interior striker wheel system, whereby chips are comminuted into fine shavings, which serve as a base material for the production of particle boards. In addition, there are timber chippers, whereby the stationary material is turned into large-size chips by a rotating and transversely-operating knife ring, the chips being further used for manufacturing OSB (Oriented Strand Board) products.

In such devices, the actual comminuting is done by slicing knives that are assembled, together with a knife retaining plate, outside of the chipping apparatus and within a template to form a knife package. The knife packages are held by knife carriers, which are arranged in a circular shape between two carrier rings around an axis of rotation, thus forming a ring of knives. To make it easier to attain the required blade projection, the knife carrier has a stop surface as a reference surface that extends along the entire length of the knife carrier, the reference surface interacting with a oppositely located blade located of the pre-adjusted knife package. This stop surface, which also serves as a reference surface, is also the zero position for the knife packages because from it the control value for the position of the blade of the slicing knife is taken. The main rule for the installation of knife packages is that all blades of the slicing knives travel in the same cutting circle.

However, as a consequence of tolerances generated during production, the stop surfaces of the knife carriers, and thus the reference surfaces for the blade cutting circle of the slicing knives, are not all positioned on one and the same circumferential line in relation to the axis of the knife ring. This leads to uneven blade projections of the slicing knives and thus, to chips of an inferior quality.

For this reason, it is already known from DE 26 28 764 to adjust the reference surface with the aid of an adjustment device to compensate for tolerances generated during production. In DE 26 28 764, the reference surface is formed by an adjustment and set screw, which can be screwed into the knife carrier, or unscrewed therefrom, coplanar to the knife package. The adjustment and set screw thereby serves as a stop for a continuous counter-pressure, and is tightly screwed to the knife package.

A disadvantage of the conventional constructions is that a maximal usable width of the slicing knife is fixed by the distance between the blade of a slicing knife and the reference surface, to which the slicing knife abuts with its rearward longitudinal edge. In view of longer operating times of the wear-prone slicing knives, the use of the widest possible slicing knives would be desirable.

SUMMARY OF THE INVENTION

It is therefore an object of the present invention to provide slicing knives with a usable width that is larger than has been previously possible.

The invention is based on the idea to design the reference surface on the knife carrier, which interacts with the knife package, in a basically punctiform shape. In conjunction with slicing knives, which each have in the area of the reference surfaces a recess extending from the rearward edge, a constructive development of a knife carrier is thus achieved, whereby the reference surfaces are within the recesses. Thus, making it possible for the rearward edge of the slicing knives to extend beyond the reference surface. The reference surface can thereby be formed by a fixed stop, but also by an adjustable element that is adjustable coplanar to the knife package.

Thanks to the invention, the operator of chipping devices of this invention will have the advantage to be able to use wider slicing knives than before. Due to their greater usable width, these slicing knives have a longer life span, which makes the chipping devices of this invention more economical all around.

Furthermore, the structure of a knife carrier according to this invention makes a shifting of the reference surface towards the middle of the knife carrier possible. This results in a more compact construction of the individual knife carriers, which opens up the possibility to accommodate more knife carriers on a circumferential line than before. A modified knife ring such as this is capable of a much higher chipping output.

In a simple embodiment of the invention, the reference surface is formed from one stop on the knife carrier for the knife package. The special merit of an embodiment such as this is its simplicity of construction, but it is only effective in the direction of the stop, that is, a knife package has to be held against the stop until it is screwed onto the knife carrier.

In a further embodiment of the invention, an interlock is created between the knife carrier and the knife package, for example, through the formation of a plug connector. This has the advantage that the knife package is already fixed in a control position when the knife package is placed on the bearing surface of the knife carrier, and only needs to be screwed on. Although it is more complex to manufacture an embodiment such as this, it contributes to greater safety in regards to maintaining the necessary blade projection.

A preferred plug connector of the invention is the slot and key principle. It is even more beneficial when the slot is arranged in the knife retaining plate and the fitting key in the knife carrier. This allows a compact design of the knife carrier with simple construction. A slot that is longer in relation to the fitting key makes it easier to thread the fitting key into the slot and allows minor position corrections in the direction of the slot after assembly.

Although the invention also includes chipping devices with fixed reference surfaces, embodiments that allow a setting of the reference surface and thus an adjustment of the zero position of the knife packages are preferred. In an example embodiment, the reference surface is part of the adjustment device, which preferably is arranged on the knife ring. This allows the knife package, which has to be removed every time the knives are being exchanged, to be reduced to only those parts that are absolutely necessary. The parts needed for an adjustment are thus protected in the knife carrier and are not inadvertently misadjusted.

A simple, but very effective and reliable type of an adjustment device includes an adjustment screw, which can be screwed to the knife carrier, with the insertion of small spacers in between. It is thereby possible that the head of the adjustment screw also functions as the reference surface for the knife package. As an alternative thereto, it is possible to attach a centering peg with the adjustment screw to the knife carrier, which interacts with the knife retaining plate, by the interposition of small spacers.

Particularly when knife carriers with an adjustment device are used, the arrangement of recesses on the knife carrier is an advantage. By arranging the adjustment device in the recess, the adjustment device disappears into the cross section of the knife carrier. This makes it possible to keep the chip removal channel free of contractions of the cross section, which is always a source of danger in regards to clogging. Thus, the chipping devices of this invention also have the benefit of increased reliability and operational safety.

In a further embodiment of the invention, the bearing surface of the knife carrier has a base, on which the knife retaining ring rests during operation. Arranging the reference surface or the adjustment device in the area of the base has the advantage that from a statical point of view, the base itself has the effect of a stabilizing element for the reference surface.

Additionally, the invention includes a ring of knives, which is also marketed as an independent part of a device of this invention. To such a knife ring, the previously made statements also apply.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
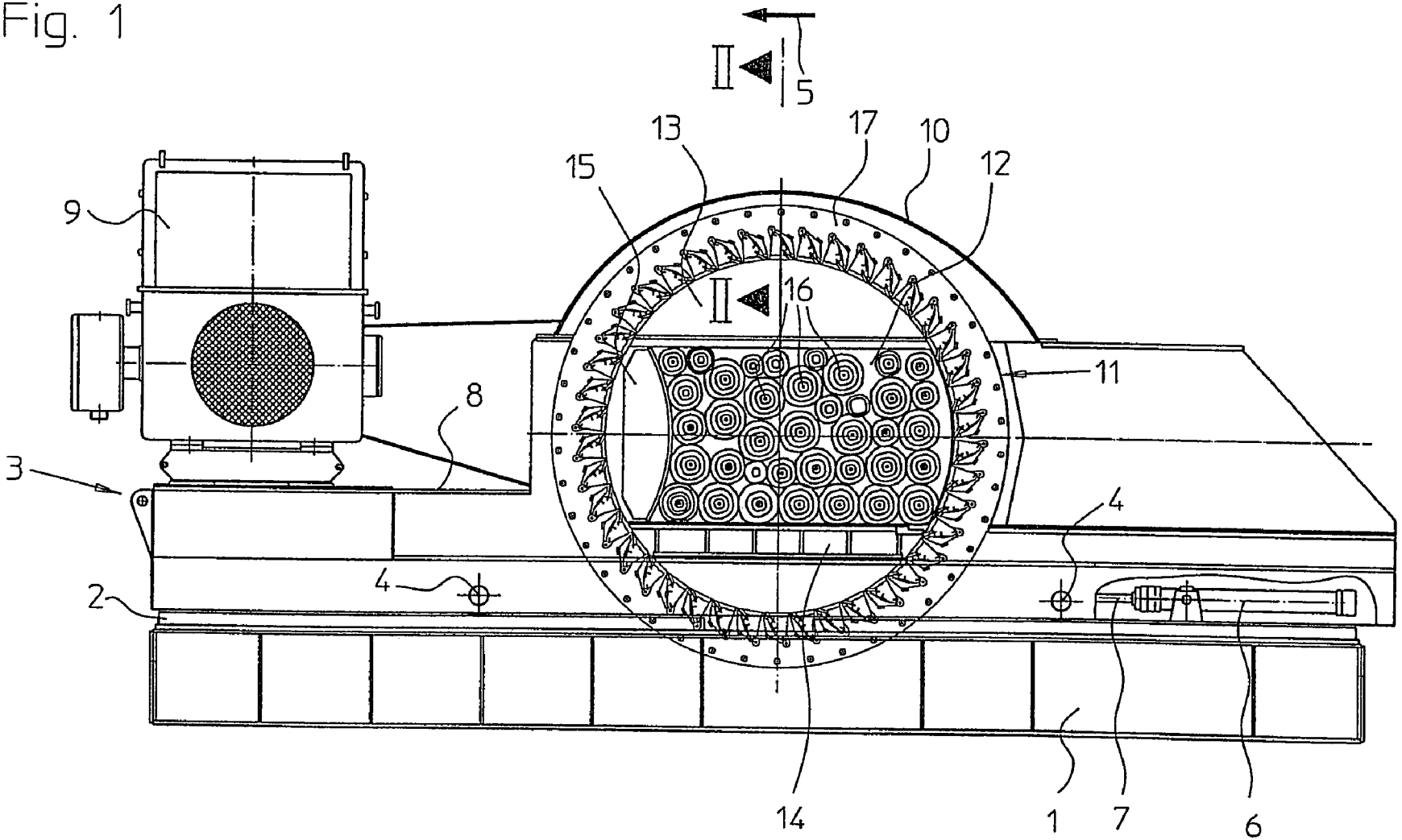
FIG. 1 shows a vertical longitudinal section through a timber chipper with a rotating knife ring.

FIG. 1 illustrates a knife ring chipper according to a preferred embodiment of the present invention for chipping timber. To clarify the invention, a chipper for making wood chips with a knife ring and an interior striker wheel, whereby the knife ring can be stationary as well as rotating, can be utilized to illustrate this invention. FIG. 1 shows a stationary substructure 1 having rails 2 arranged along its upper side in plan view. The rails 2 serve as a track for the base frame 3 of the engine, which is cross-slidingly arranged on wheels 4 in the direction of the arrow 5. A cylinder piston unit 6 is fixedly connected to the substructure 1, its moving piston 7 activating the base-frame 3 of the engine, thus causing a lateral movement of the base frame 3 of the engine. Furthermore, the base frame 3 has a platform 8, which carries an electric motor 9. Additionally, a hood-shaped housing 10 is attached to the base frame 3, which serves as a receptacle for a knife ring 11 than can be rotated freely around a horizontal axis. Whereas the rear wall of the housing 10 is closed and serves as a storage for a drive shaft of the ring of knives 11, the front of the housing 10 has a circular opening, through which the chipping chamber 12 can be freely accessed. Towards the top, the chipping chamber 12 is bound by a circular arc segment 13, a bent side of which extends in close proximity to the ring of knives 11. In the lower region, a bracing floor construction 14 forms the boundary of the chipping chamber 12 and, like the circular arc segment 13, is fixedly connected with the housing 10. The left boundary area of the chipping chamber 12, from an illustration view point, is formed by a counter-stop 15, which extends axially into the chipping chamber 12, is convex in cross section, and is fixedly arranged opposite the substructure 1 of the apparatus and thus does not follow the lateral movements of the base frame 3 of the engine. The opposite side of the chipping chamber 12 is formed by a segment of the inner side of the knife ring 11 and forms a comminution path.

The material to be processed, that is, logs 16, as well as the counter-stop 15 extend with an unencumbered part of their length axially into the chipping chamber 12. The part of the logs 16 that is located outside the chipping chamber 12 is in a feeder device (not shown), at which end it is firmly clamped together for the comminution process. Additionally, there are hold-down clamps (not shown) in the chipping chamber 12, which hold the logs 16 in place during the comminution process. The comminution of the logs 16 is done by lateral movement of the base frame 3 of the engine in the direction of arrow 5 while the knife ring 11 is rotating, whereby the logs 16, due to the stationary counter-stop 15, are pressed against the comminution path, where they are engaged by the chipping tools.

Figure 2:
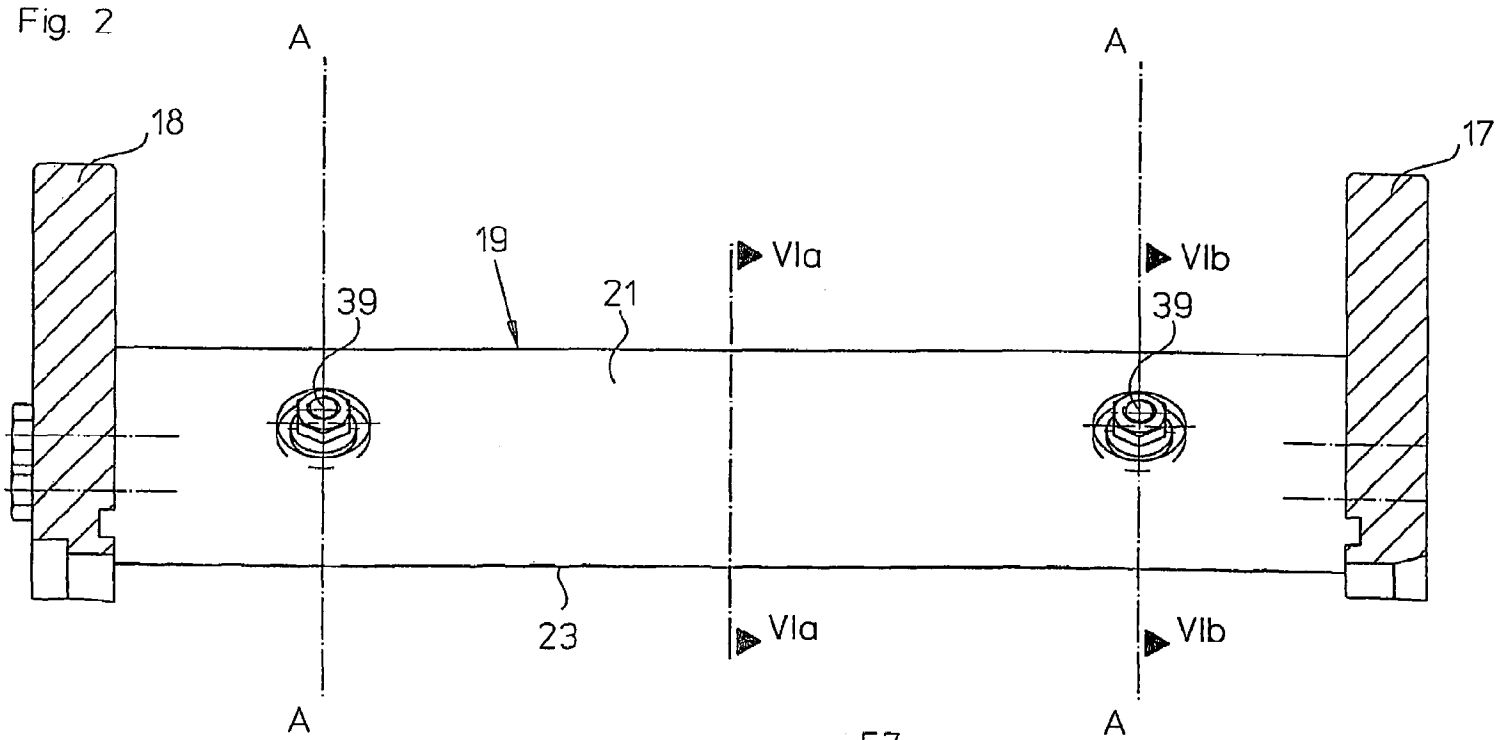
FIG. 2 shows a partial cross section along the line II-II through the knife ring illustrated in FIG. 1.
Figure 3:
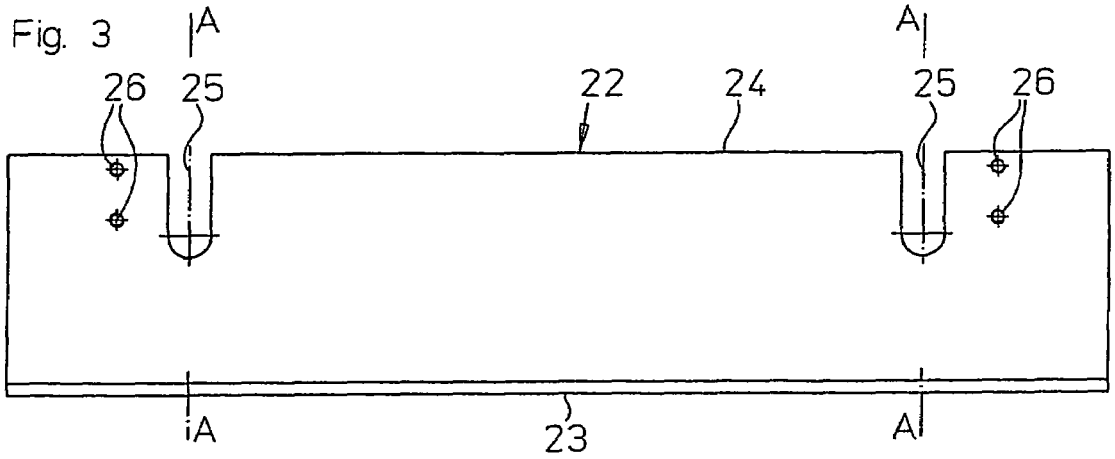
FIG. 3 shows a top view of a slicing knife of this invention.
Figure 4:
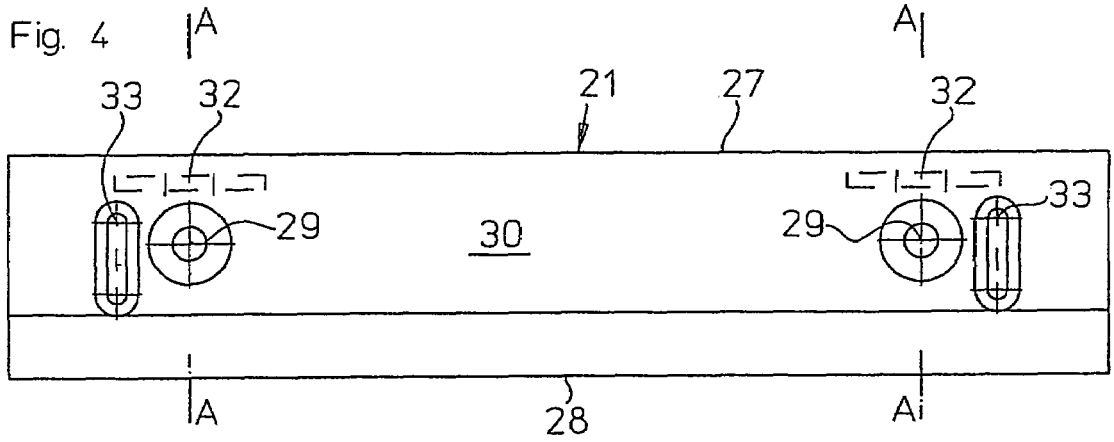
FIG. 4 shows a top view of a knife retaining plate of this invention.
Figure 5:
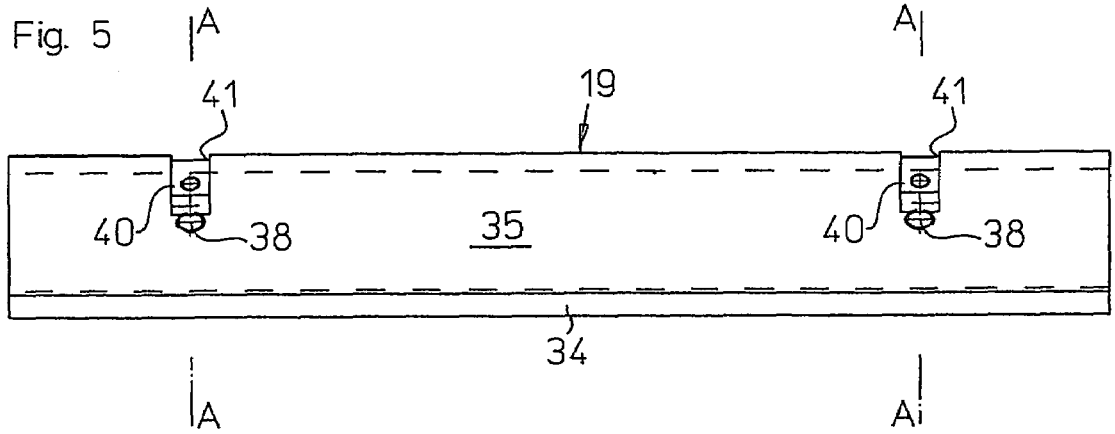
FIG. 5 shows a front view of a knife carrier of this invention.
Figure 6:
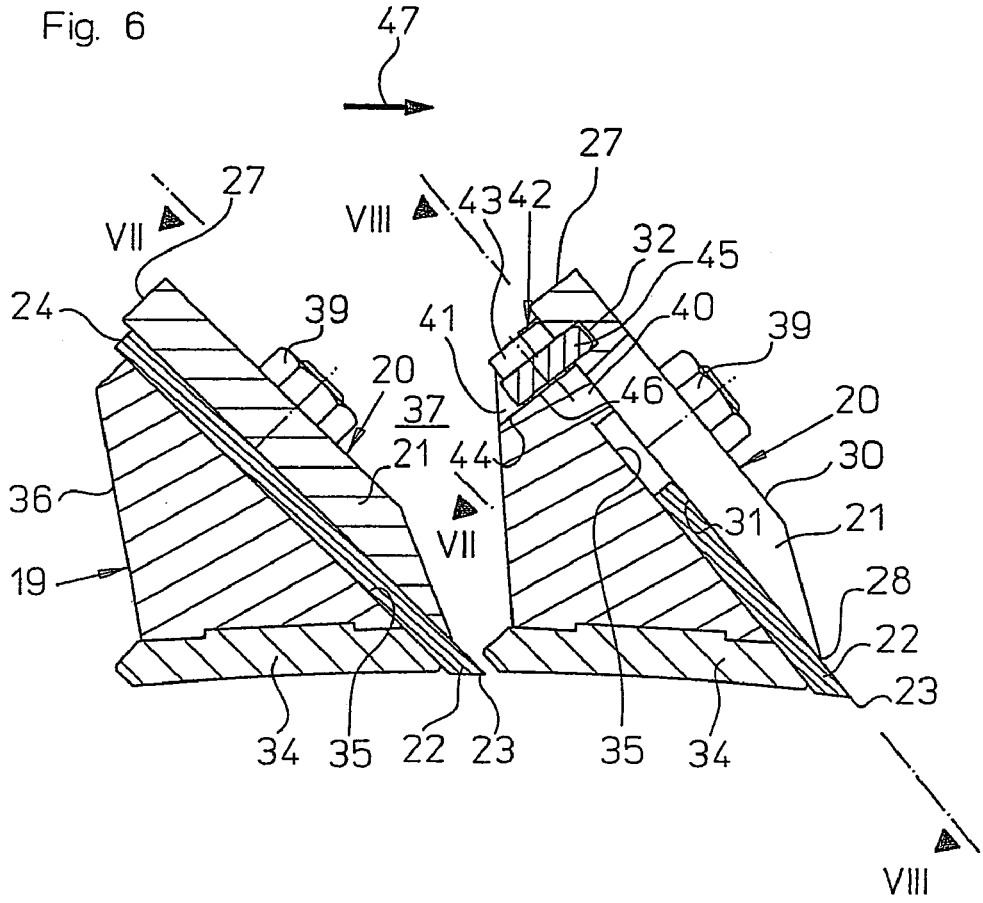
FIG. 6 shows cross sections along the lines VIa-VIa and VIb-VIb through the knife carriers illustrated in FIG. 2.

The detailed construction of the knife ring 11 is illustrated in FIG. 2. Basically, the ring of knives 11 includes two concentric ring wheels 17 and 18 that are arranged with an axial space in between, and which are connected to knife carriers 19, the knife carriers being distributed axis-parallel and annular around the axis of rotation in a circular shape. Whereby, the upper front sides of the knife carriers 19 and the inner sides of the ring wheels 17 and 18 are screwed together. Each knife carrier 19 can function as a receptacle for the chipping tools in their required operational position, which is accomplished by mounting them in mounting planes A. In the illustrated example, the chipping tools include knife packages 20, each knife package 20 including a knife retaining plate 21 and a slicing knife 22. The individual elements of such a unit, that is, the slicing knife 22, the knife retaining plate 21 and the knife carrier 19, are illustrated in FIGS. 3 to 5. Their respective arrangement during operation is clearly illustrated in FIG. 6.

The slicing knife 22 illustrated in FIG. 3 extends in a distinct longitudinal direction, whereby the front longitudinal edge, in FIG. 3 the lower longitudinal edge, forms a blade 23. The edge segments of the rearward longitudinal edge 24 of the slicing knife 22 are provided with a slit-shaped recess 25 with a rounded bottom and an extension that is transverse to the longitudinal extension direction. Additionally, there are two threaded bores 26 between the front upper side and the recess 25.

A knife retaining plate 21 that is suitable for forming a knife package 20 is illustrated in FIG. 4. Basically, the layout of the knife retaining plate 21 is, in principal, the same as the slicing knife 22, having a rearward longitudinal edge 27 and a front longitudinal edge 28. In the illustration a lower portion of the front longitudinal edge 28 tapers to a pointed longitudinal edge. Each of the two mounting planes A is provided with a tapered bore 29, which extends through the thickness of the knife retaining plate 21. The tapered bore 29 has a larger diameter on a top side 30 and a smaller diameter on a bottom side 31 of the knife retaining plate 21.

Between the tapered bores 29 and the rearward longitudinal edge 27, there are grooves 32 that are arranged on the bottom side 31 in the area of the mounting planes A, the grooves extending parallel to the longitudinal extension direction and their depths equaling about one half of the thickness of the knife retaining plate 21.

In addition, a longitudinal hole 33 is arranged between the tapered bores 29 and the upper front sides of the knife retaining plate 21, which is tapered in a way similar to the tapered bores 29. The longitudinal holes 33 extend transversely to the longitudinal extension direction.

The slicing knife 22 illustrated in FIG. 3 and the knife retaining plate 21 illustrated in FIG. 4 are combined outside the ring of knives 11 in a specially provided template to form a knife package 20. The template provides for a predetermined width of the knife package 20, which, starting from a defined zero position on the knife carrier 19, results in a desired blade projection into the comminution chamber 12. Depending on the condition of attrition of the slicing knife 22, the slicing knife 22 and the knife retaining plate 21 are thereby placed on top of each other, transversely to the longitudinal extension direction of the knife retaining plate 21 and with the required overlap, and are connected with screws (not shown). The threaded part of the screws thereby extends through the longitudinal holes 33 into the threaded bores 26 of the slicing knife 22. The final location of the screw heads is in the longitudinal holes 33 so that they do not protrude beyond the top side 30 of the knife retaining plate 21. The illustrated extension of the longitudinal hole 33 being transverse to the longitudinal axis of the knife retaining plate 21 allows readjusting, and thus an adjustment of the knife package 20 to the current condition of wear and tear of the respective slicing knife 22.

The knife packages 20 thus adjusted to a predetermined width are subsequently fastened to a knife carrier 19, as illustrated in FIG. 5, for example. As can be particularly seen in FIGS. 5 and 6, the knife carrier 19 is rod-shaped and has a triangular cross section. On the side facing the chipping chamber, a wear shoe 34 is arranged.

The side of the knife carrier 19, which in a direction of rotation 47 is the front side, forms a bearing surface 35 for the knife package 20. The side, which in a direction of rotation 5 is the rearward side 36 of the knife carrier 19, forms, in conjunction with the knife package 20 of a subsequent knife carrier 19, a chip removal channel 37, through which the chipped material is radially removed to the outside by centrifugal force.

A more detailed illustration of the bearing surface 35 is shown in FIG. 5, where it can be seen that the bearing surface 35 extends basically in a plane direction to accommodate the back of the slicing knife 22. Perpendicular to the bearing surface 35, there is a threaded bore 38 in each of the mounting planes A, with which fastening screws 39 (FIGS. 6 and 7) engage. Between the threaded bore 38 and the rearward longitudinal edge of the knife carrier 19, there is a base 40, each having a width that fits into the recess 25 of the slicing knife 22. The height of the base 40 substantially equals the thickness of the slicing knife 22, whereby the surface of the base 40 forms a support for the bottom side 31 of the knife retaining plate 21 when the screws 39 are tightened. This is particularly illustrated in FIG. 6.

The rearward longitudinal edge of the knife carrier 19 is provided in both mounting planes A with a niche 41, which is rectangular in cross section, the bottom 44 of the niche and the base 40 forming a flush connection. The niche 41 serves as a receptacle for an adjustment device 42. For this purpose, a threaded bore is provided in the bottom 44 of the niche 41, with which an adjustment screw 43 engages. The head of the adjustment screw 43 tightens a cuboid centering peg 45 against the bottom 44 of the niche 41, with the insertion of one or several small spacers 46 in between. With a narrow side, the centering peg 45 extends beyond the surface of the base 40 and due to appropriately calculated measurements, engages free of play and transversely to the longitudinal extension direction of the knife carrier 19 with the groove 32 on the bottom side 31 of the knife retaining plate 21.

In this way, the centering peg 45 forms a reference surface, which fixes the relative position of the knife package 20 against the knife carrier 19, and thus the blade projection.

Since tolerances generated during production can result in minor deviations of the reference position of the knife carriers 19 in the ring of knives 11, an insertion of a corresponding number of small spacers 46 between the centering peg 45 and the bottom 44 of the niche 41 makes it possible to compensate for these production tolerances.

Figure 7:
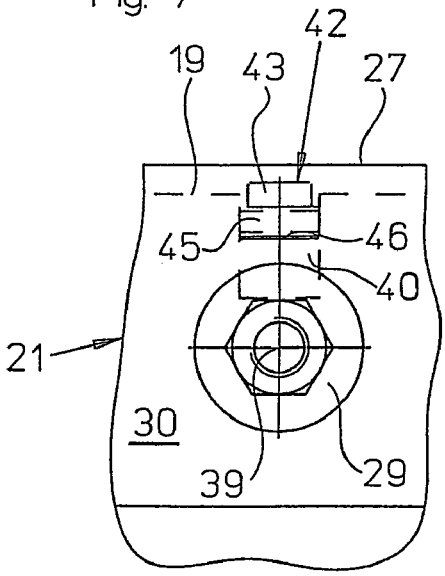
FIG. 7 shows a partial view along the line VII-VII through the knife carrier illustrated in FIG. 6.
Figure 8:
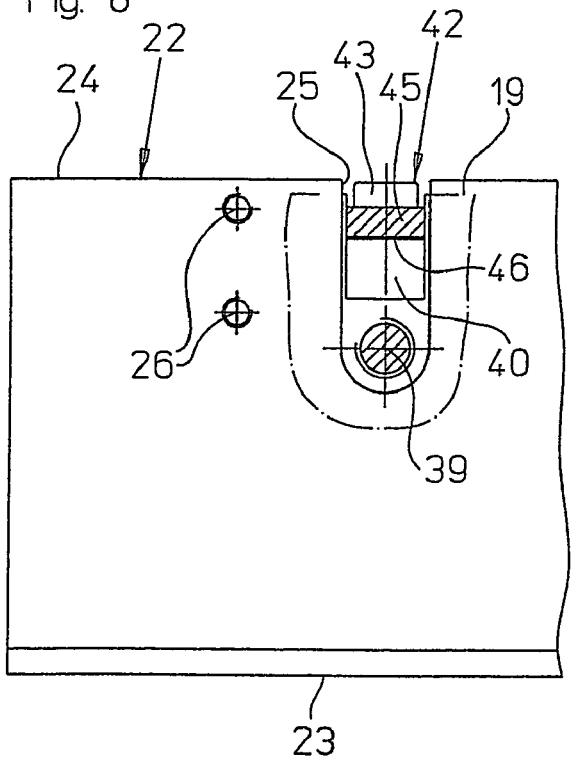
FIG. 8 shows a partial cross section along the line VIII-VIII through the knife carrier that is illustrated in FIG. 6.

As can be clearly seen in FIG. 7, and particularly in FIG. 8, the application of slicing knives 22 with a greater width is possible due to the invention-characteristic arrangement of the reference surface in the form of the centering peg 45 inside the projection of the recess 25 of the slicing knife 22, the projection extending vertically to the bearing surface 35. Thereto, the rear longitudinal edge 24 can coincide with or project above the corresponding longitudinal edge of the knife carrier 19.

Due to the provision of niches 41 for the adjustment device 42, it is possible to keep the chip removal channel free of components that may obstruct the chip removal, even if the structure of the cross section of the knife carrier 19 is compact.

Figure 9:
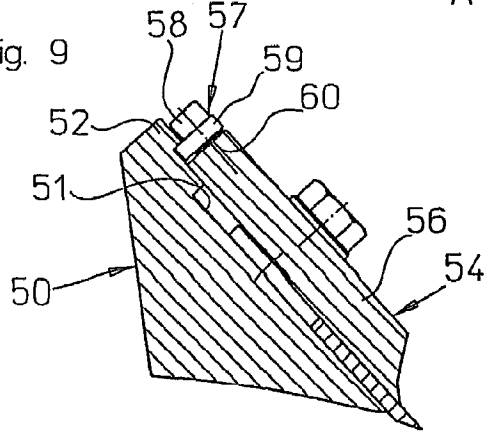
FIG. 9 shows a cross section of an alternate embodiment of a knife carrier of this invention.

The illustration in FIG. 9 is to demonstrate that the invention is not limited to the embodiments illustrated in FIGS. 1 to 8, in which the reference surface can be adjusted by using an adjustment device 42 that is located on the knife carrier 19. Rather, a plurality of embodiments and combinations are possible within the scope of the invention, whereby the adjustment device or the centering plug alone is mounted to the knife retaining plate, for example.

The knife carrier illustrated in FIG. 9 has a mostly plane bearing surface 51, which only in the mounting planes A is interrupted by a respective base 52. The base 52 is twotiered, with a first deeper surface and a second higher surface that connects to the rearward longitudinal edge of the knife carrier 50 and is located opposite the support surface 51, The support surface 51 serves as a receptacle for the knife package 54, which is formed by a slicing knife 55, which is basically the same as the one described in FIG. 3, and a knife retaining plate 56, which is a modification of the one described in FIG. 4.

In comparison to the example embodiments described in FIGS. 1 to 8, the knife retaining plate 56 has an adjustment device 57, which is arranged at the rearward longitudinal edge of the knife retaining plate 56 in the area of the corresponding recesses of the slicing knife 55. The adjustment device 57 in turn includes a adjustment screw 58, which engages with a threaded bore in the rearward longitudinal edge of the knife retaining plate 56. In its turn, the head of the adjustment screw 58 tightens a stop element 59 against the rearward longitudinal edge of the knife retaining plate 56, with the insertion of one or several small spacers 60 in between.

In fastening the knife package 54 onto the knife carrier 50, the tiers between the first, deeper surface of the base 52 and the second, higher surface serve as a reference, that is, a stop surface for the stop element 59 of the knife package 54. By inserting the appropriate quantity of small spacers 60, the required blade projection can be set.

Since the extension of the base 52 in the longitudinal direction of the knife carrier 50 does not exceed the recess in the slicing knife 55, the slicing knives 55 can also have a greater width than conventional knives according to this embodiment of the invention. This allows the rearward longitudinal edge of the slicing knife 55 to extend to the rearward longitudinal edge of the knife carrier 50.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An apparatus for chipping material having a ring of knives being arranged within a chipping chamber, the apparatus comprising:

a plurality of knife carriers being arranged around a knife ring axis in a substantially circular fashion, each of the knife carriers having a bearing surface, on which a knife package comprised of a knife retaining plate and a slicing knife is held by fasteners in an operational position at a predetermined angle and having a predetermined blade projection, wherein the knife carriers each have a reference surface, which interacts with the knife package, a blade projection being determined on the basis of the reference surface, wherein the slicing knife has at least one recess on a rearward longitudinal edge thereof for positioning the knife package on the knife carrier, and wherein the reference surface is formed by a substantially perpendicular projection that extends from the bearing surface and is arranged within the recess.

2. The apparatus according to claim 1, wherein the reference surface is a stop that functions between the knife retaining plate and the knife carrier.

3. The apparatus according to claim 1, wherein the reference surface is formed by a positive fit between the knife retaining plate and the knife carrier.

4. The apparatus according to claim 1, wherein the reference surface is integrated into a connection assembly formed as a slot and key connection, between the knife retaining plate and the knife carriers.

5. The apparatus according to claim 4, wherein the slot is arranged in the knife retaining plate and the key is arranged in the knife carrier.

6. The apparatus according to claim 4, wherein the slot is longer than the key.

7. The apparatus according to claim 1, wherein the reference surface interacts with an adjustment device, an adjustment area of which extending substantially parallel to a transverse direction of extension of the knife retaining plate.

8. The apparatus according to claim 7, wherein the adjustment device has an adjustment screw that tightens against the knife carrier or the knife retaining plate, and is adapted to have small spacers inserted therebetween.

9. The apparatus according to claim 7, wherein the reference surface is formed by a part of the adjustment device, which is arranged on the knife carrier.

10. The apparatus according to claim 7, wherein the knife carrier has at least one niche, in which the adjustment device is arranged.

11. The apparatus according to claim 10, wherein the niche originates in the rearward longitudinal edge of the knife carrier and extends into the bearing surface.

12. The apparatus according to claim 1, wherein a base projects from the bearing surface, and wherein the reference surface, or an adjustment device with the reference surface, is arranged in the area of the base.

13. The apparatus according to claim 1, wherein the fasteners are screws, which are threaded through the knife package in the area of the recesses of the slicing knife.

14. The apparatus according to claim 1, wherein at least in edge segments of the slicing knife a recess is formed, and wherein on the knife carrier, the reference surface that corresponds to the recess of the slicing knife is arranged.

15. A ring of knives having a plurality of knife carriers that are distributed around a knife ring axis in a circular shape, each of the knife carriers having a bearing surface, on which a knife package comprised of a knife retaining plate and a slicing knife is held by fasteners in an operational position at a predetermined angle and having a predetermined blade projection, wherein the knife carrier has a reference surface, which interacts with the knife package and on the basis of which the blade projection is determined, wherein, for the positioning of the knife package on the knife carrier, the slicing knife has at least one recess originating from a rearward longitudinal edge, and wherein the reference surface is formed by a substantially perpendicular projection that extends from the bearing surface and is arranged within the recess.

16. The apparatus according to claim 1, wherein the ring of knives is adapted to rotate or to be stationary within the chipping chamber.

17. A knife assembly for a chipping apparatus, the knife assembly comprising:

a knife carrier having a bearing surface and a lower surface, the bearing surface having a projection extending substantially perpendicular from the bearing surface;

a knife retaining plate having at least one bore provided therein, a central axis of the bore being on a mounting plane that extends perpendicular to an upper surface of the knife retaining plate; and a slicing knife being provided between the knife carrier and the knife retaining plate, the slicing knife having a blade formed on a first edge thereof and projecting beyond the lower surface of the knife carrier, the slicing knife having at least one aperture extending from a second edge of the slicing knife substantially towards the first edge, the second edge being opposite to the first edge, the at least one aperture having a central axis that lies on the mounting plane, wherein the projection of the knife carrier extends within the at least one aperture of the slicing knife, wherein a height of the projection of the knife carrier is substantially equal to a thickness of the slicing knife, and wherein a projection of the blade of the slicing knife beyond the lower surface of the knife carrier is determined on the basis of a reference surface, the reference surface being formed on a surface of the projection of the knife carrier.

18. The knife assembly according to claim 17, wherein the projection of the knife carrier extends through the at least one aperture of the slicing knife such that an upper surface of the projection directly contacts a lower surface of the knife retaining plate.

19. The knife assembly according to claim 17, wherein the slicing knife is fixedly mounted to the knife retaining plate.

* * * * *

UNITED STATES PATENT AND TRADEMARK OFFICE

CERTIFICATE OF CORRECTION

PATENT NO. : 7,377,298 B2
APPLICATION NO. : 11/043974
DATED : May 27, 2008
INVENTOR(S) : Pallmann It is certified that error appears in the above-identified patent and that said Letters Patent is hereby corrected as shown below:

On title page

Change from:

Item (73) Assignee: Pallmann Maschinenfabrik GmbH & Co., KG, Zwelbruecken (DE)

To:

Item (73) Assignee: Pallmann Maschinenfabrik GmbH & Co., KG, Zweibruecken (DE)

Signed and Sealed this

Fifth Day of August, 2008

JON W. DUDAS
*Director of the United States Patent and Trademark Office*